United States Patent [19]

Borcoman

[11] 4,259,050

[45] Mar. 31, 1981

[54] MULTI-PURPOSE INSTALLATION FOR THE MANUFACTURE OF SMALL AND MEDIUM PRODUCTS OF REINFORCED AND UNREINFORCED CONCRETE

[76] Inventor: Mircea Borcoman, 8, rue des Dardanelles, 75017 Paris, France

[21] Appl. No.: 21,608

[22] Filed: Feb. 5, 1979

[30] Foreign Application Priority Data

Jun. 6, 1977 [FR] France ..... 77 17279

[51] Int. Cl.[3] ..... B28B 5/00

[52] U.S. Cl. ..... 425/88; 425/443; 425/451.5

[58] Field of Search ..... 425/88, 443, 451.5

[56] References Cited

U.S. PATENT DOCUMENTS

| | | | |
|---|---|---|---|
| 3,868,207 | 2/1975 | Otsuki et al. | 425/88 |
| 3,874,832 | 4/1975 | Ohta | 425/88 |
| 3,920,369 | 11/1975 | Boehringer et al. | 425/88 |
| 3,982,874 | 9/1976 | Nobbe | 425/88 |
| 4,019,848 | 4/1977 | Bolhorn | 425/443 |

*Primary Examiner*—John Parrish

[57] ABSTRACT

The invention relates to an installation for the manufacture of a large range of small and medium products of reinforced and unreinforced concrete.

This installation comprises: a series of boards A, an installation B for distributing the concrete, smoothing, and discharging the hardened products from the installation and for cleaning and oiling the boards; a tilting frame C with one or two rows of molds; a device D, for introducing boards onto the frame; some molds or batteries of molds E, provided with concrete-deareating means; and a hardening system F, dismountable and usable either in an overhead installation or in a below-ground installation.

This installation ensures, apart from diversification of production, a substantial improvement in the quality of the products and in their cost price.

11 Claims, 13 Drawing Figures

Fig.12
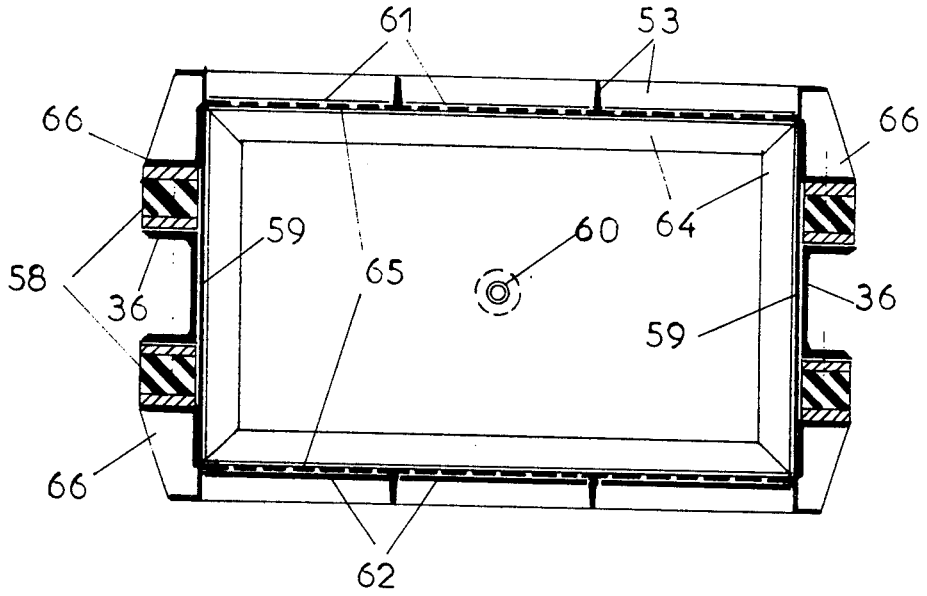
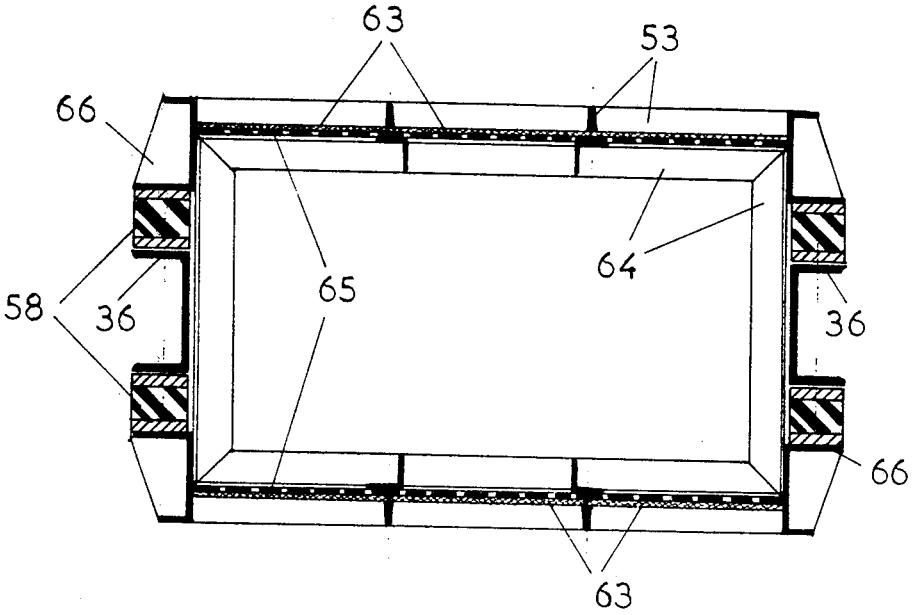
Fig.13

MULTI-PURPOSE INSTALLATION FOR THE MANUFACTURE OF SMALL AND MEDIUM PRODUCTS OF REINFORCED AND UNREINFORCED CONCRETE

Field of the Invention

The invention relates to an installation for the manufacture of a large range of small and medium size products of reinforced and unreinforced concrete such as for example: ordinary and special curbs, ordinary and special gutters, covering and closing slabs, stakes, posts, double block sleepers, etc., capable of being produced with a better product surface appearance and increased strength.

Prior Art

Two principal types of installations for the manufacture of such elements are known.

The first type uses vibratory pressing of the concrete in very well machined molds and routing of the bare products on wooden boards. This type of installation has very narrow limits as regards diversification of the products to be manufactured, high manufacturing costs consequent upon rapid wear of the molds and of the wooden boards and requires considerable capital investment.

The second type uses the casting of concrete into batteries of molds, and unmolding by tilting and the routing of the bare products on metal boards. This type introduces an improvement from the point of view of diversification of the products to be manufactured but known installations do not succeed in achieving under good conditions the operations of distribution of the concrete, vibration, smoothing, compaction of the boards and unmolding, especially where a wide range of products to be manufactured in concerned and nor do they ensure a good surface on the products.

SUMMARY OF THE INVENTION

It is an object of the invention to provide the concrete manufacturing industry with a multipurpose installation which can ensure the manufacture of a wider range of small and medium size products of reinforced and unreinforced concrete under better conditions of cost price and quality.

According to the invention there is provided a multipurpose installation for the manufacture of such products characterized by the fact that it comprises:

a common distribution installation for the concrete, smoothing, removal of the hardened products from the installation and cleaning and oiling of the metal boards, a tilting frame with one or two rows of molds, a device for introducing the boards onto the frame, one or several molds assembled in batteries, provided with means enabling at the same time the de-aeration of the concrete and good surface quality to be obtained, a dismountable hardening circuit useable both in an overhead design or in a below ground design.

Preferably, the common distribution installation for the concrete, smoothing, removal of hardened products from the production line and cleaning and oiling of the boards includes a carriage-frame equipped with means for the proportioning and distribution of the concrete according to the volume and shape of the molds, pusher means for the hardened products from the board placed at the side of the frame and cleaning and oiling means for said boards, so that in the forward travel of the carriage the distribution of the concrete into the molds, the pushing of the hardened products from the board is effected and, in the return travel, the smoothing of the concrete and the cleaning and oiling of the board is effected.

Preferably, the tilting frame provided with rapid fastening means, with one or two rows of molds, with devices for compacting the boards on said molds, means for connecting vibrators and means for connecting to a vacuum pump, are fixed on the same framework as the installation described above so as to obtain a "compact casting-unmolding head".

Advantageously, the device for introducing the boards, provided with means for raising said boards to the desired level and means for pushing the boards into the compacting device of the frame, is coupled to the casting-unmolding head so as to permit the carriage-frame described above to carry out at the same time the operations of proportioning, distribution and smoothing of the concrete and the operations of removing the hardened products from the board and the cleaning and oiling of the latter.

The molds or batteries of molds provided, with one or several shelves of folded sheet metal, with an assembly frame and with one or several beams provided with means for attaching vibrators and support means to the frame, are formed in two principal modifications, in no way limited, according to the surface finishing needs of the product to be manufactured.

In the first modification (I), the shell is made provided with holes, or of perforated sheetmetal, on the contour which has to have a better appearance and the mold or the battery of molds is closed in such a way that, by connecting to a vacuum pump, it is possible to carry out a suction phenomenon, enabling the maintenance in attached position, on said contour, of a smooth floating jacket or provided with stripes or imprintations (in paper, textile, plastics material, etc.), for the period of filling and compacting and so that, by stopping the suction and the unmolding, this jacket remains adhered to the concrete. It this was a good product surface (striated, smooth) and easy unmolding are obtained, the cleanliness of the molds is maintained and the bare products are protected against condensed water drops (when a steam hardening circuit is used).

In the second modification (II), on the shell provided with holes (or formed of perforated sheetmetal) is fixed a filtering layer (of felt, cloth, gauze, metal gauze, etc.) so that by the vibration of the concrete said layer allows excess water and a large amount of air to pass, thus improving not only the surface but also the strength of the product.

Advantageously, the hardening circuit includes means for routing the boards provided with bare products over two superimposed tracks hooked onto a dismountable metallic framework which, closed by an isothermal envelope, becomes an aerial tunnel and which, positioned notably as a support-flooring in a tank, forms with the latter an underground tunnel.

The invention comprises, apart from the features described above, certain other features which will be more explicitly considered below, with respect to two preferred embodiments, described with reference to the accompanying drawings but which are in no way limiting.

BRIEF DESCRIPTION OF THE DRAWINGS

FIG. 12 is a longitudinal section of a battery of molds for slabs, designed according to modification "I".

FIG. 13 is a longitudinal section of the same battery, designed according to the modification "II".

DETAILED DESCRIPTION OF THE PREFERRED EMBODIMENTS

The installation for the manufacture of small and medium elements of reinforced and unreinforced concrete comprises: a series of metal boards A, an installation B, for distributing concrete, smoothing, removing hardened products from the installation, and cleaning and oiling the boards; a tilting frame C, with one or two rows of molds, a device D for introducing boards onto the frame; some molds or batteries of molds E, provided with means for de-aerating the concrete; and a hardening circuit F, dismountable and usable both in the overhead design and in the below ground design.

Figure 1:
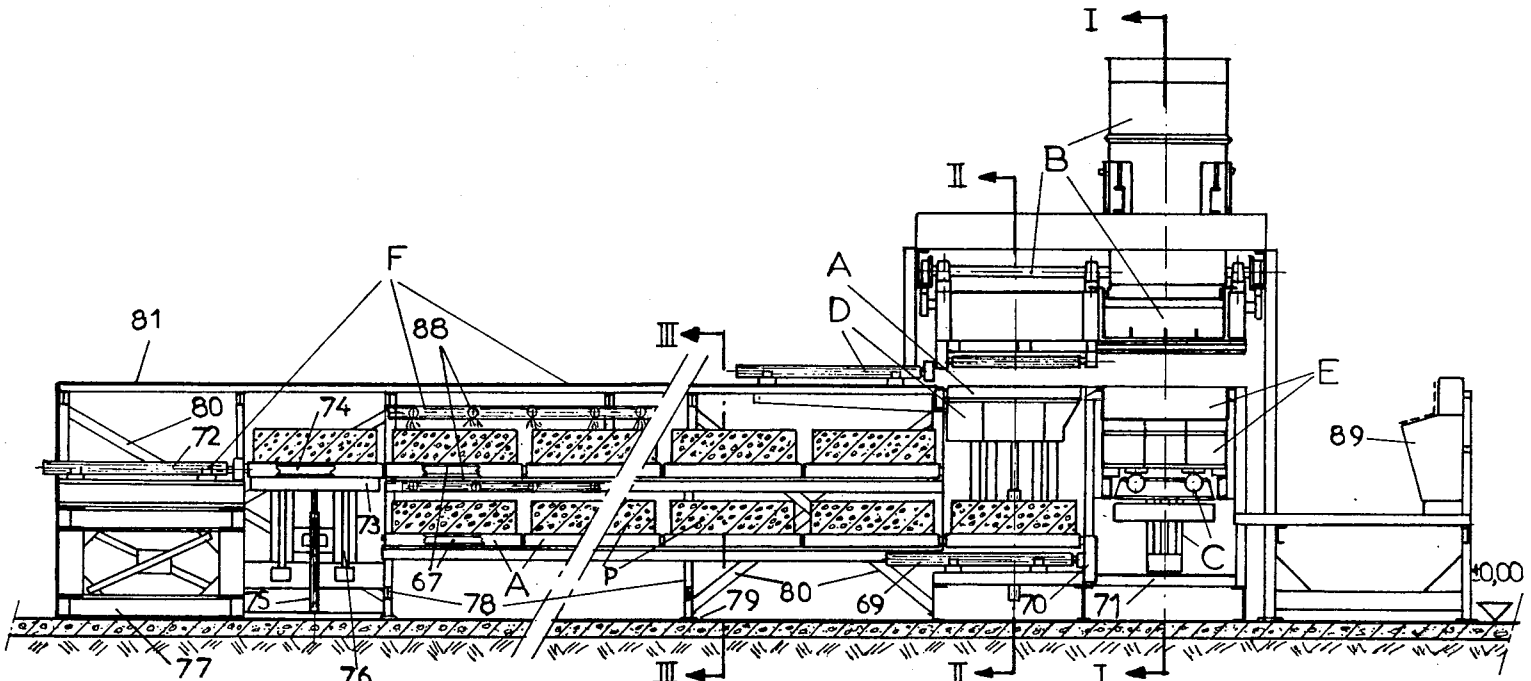
FIG. 1 of these drawings is a longitudinal section of a multipurpose installation for the manufacture of small or medium elements of reinforced or unreinforced concrete havng an aerial hardening circuit.
Figure 2:
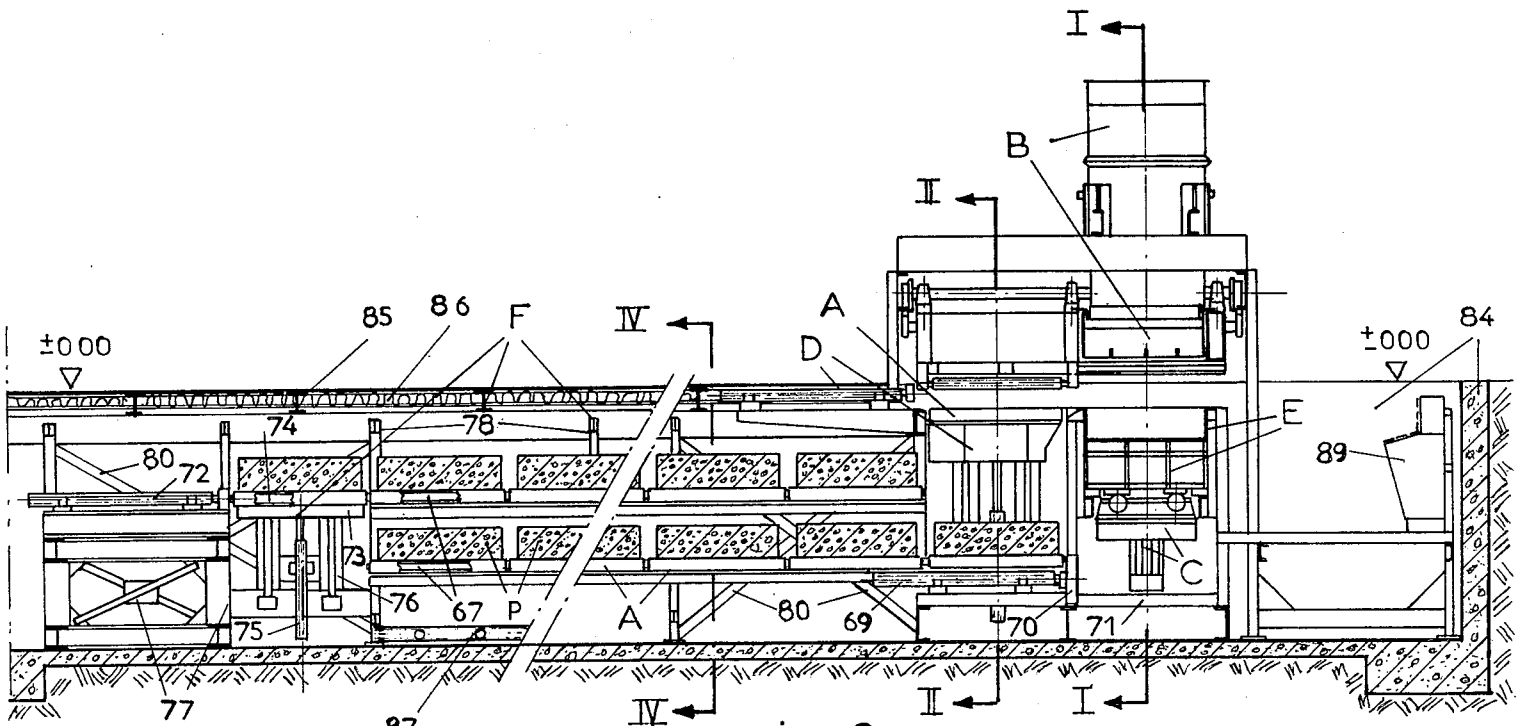
FIG. 2 is a longitudinal section of an installation having a below ground hardening circuit.
Figure 3:
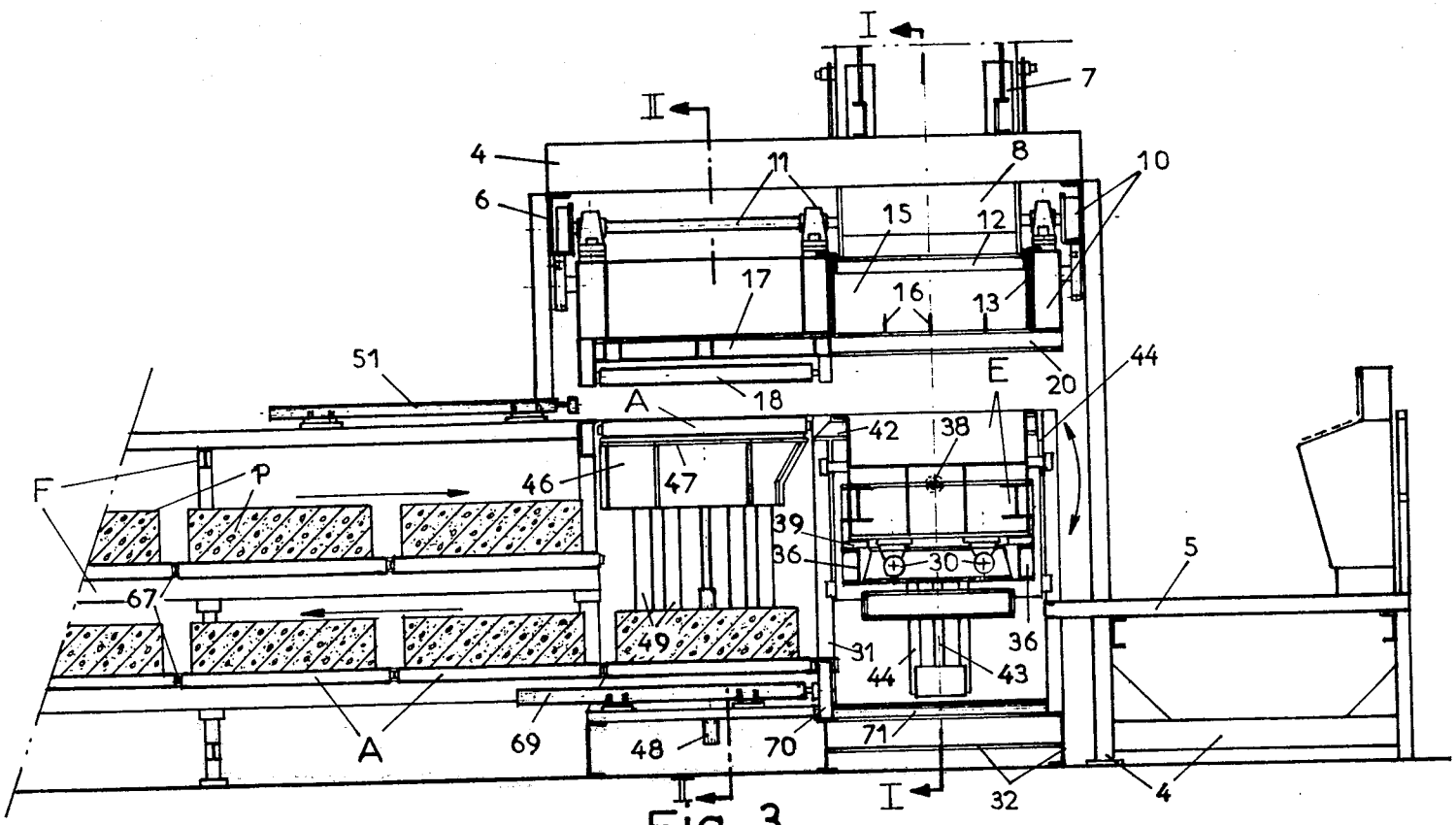
FIG. 3 is a longitudinal section, on a larger scale, of the casting-unmolding head of such an installation having a tilting frame with one row of molds.
Figure 4:
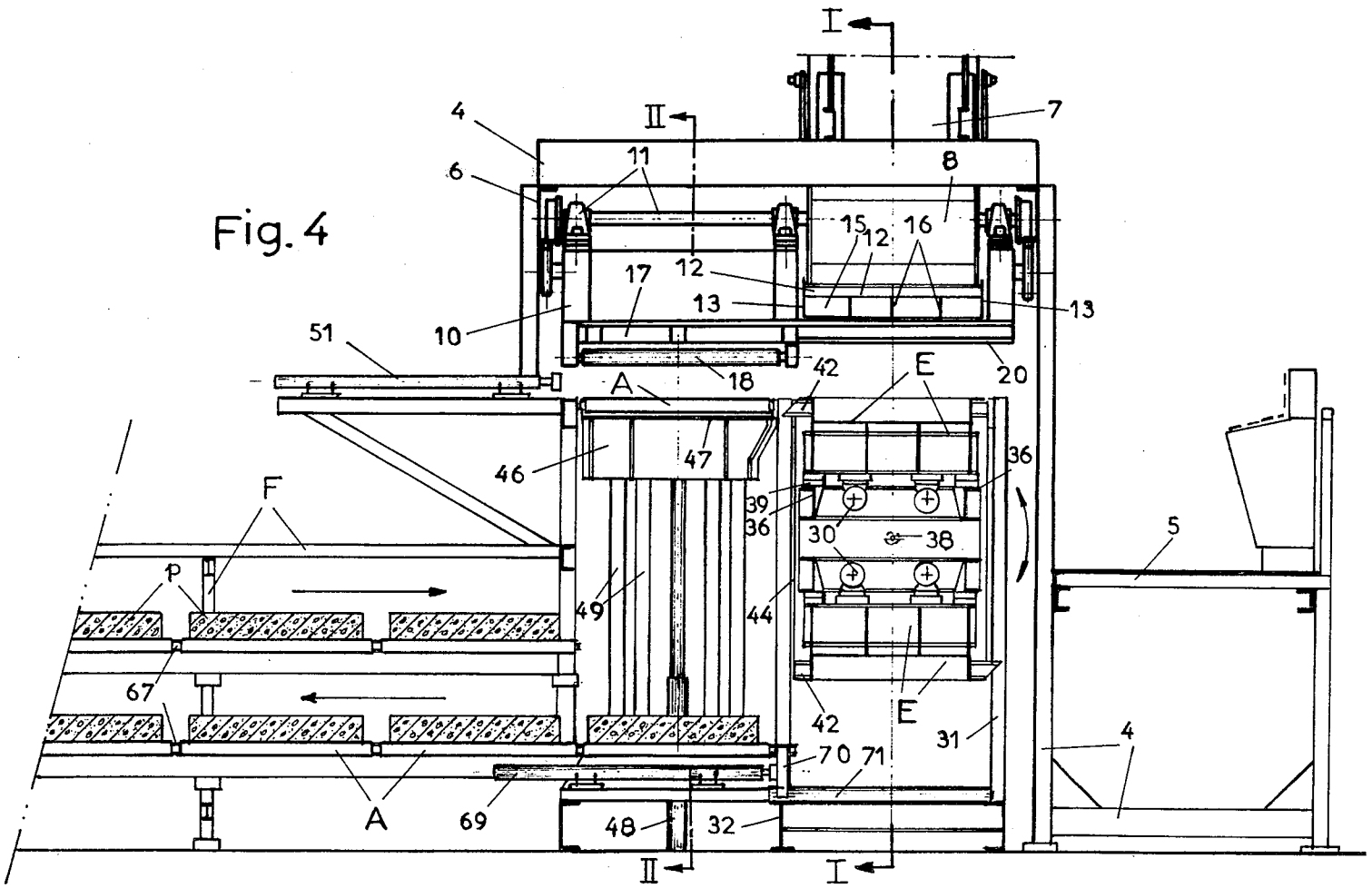
FIG. 4 is a longitudinal section, on a larger scale, of the casting-unmolding head of such an installation, having a tilting frame with two rows of molds.
Figure 5:
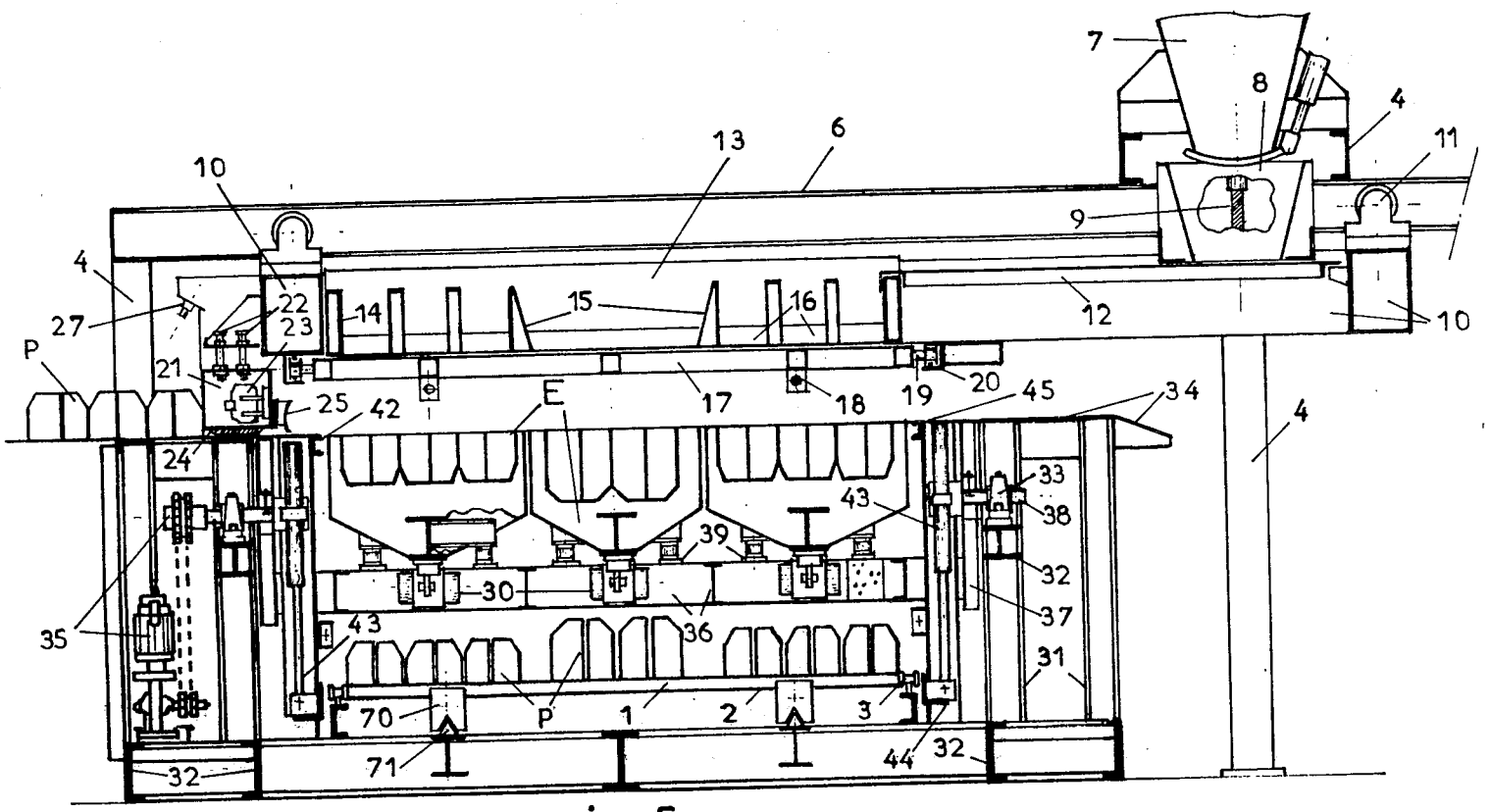
FIG. 5 is a cross-section along the line I—I (FIGS. 1, 2 and 3) through the casting-unmolding head, having a tilting frame with one row of molds.
Figure 6:
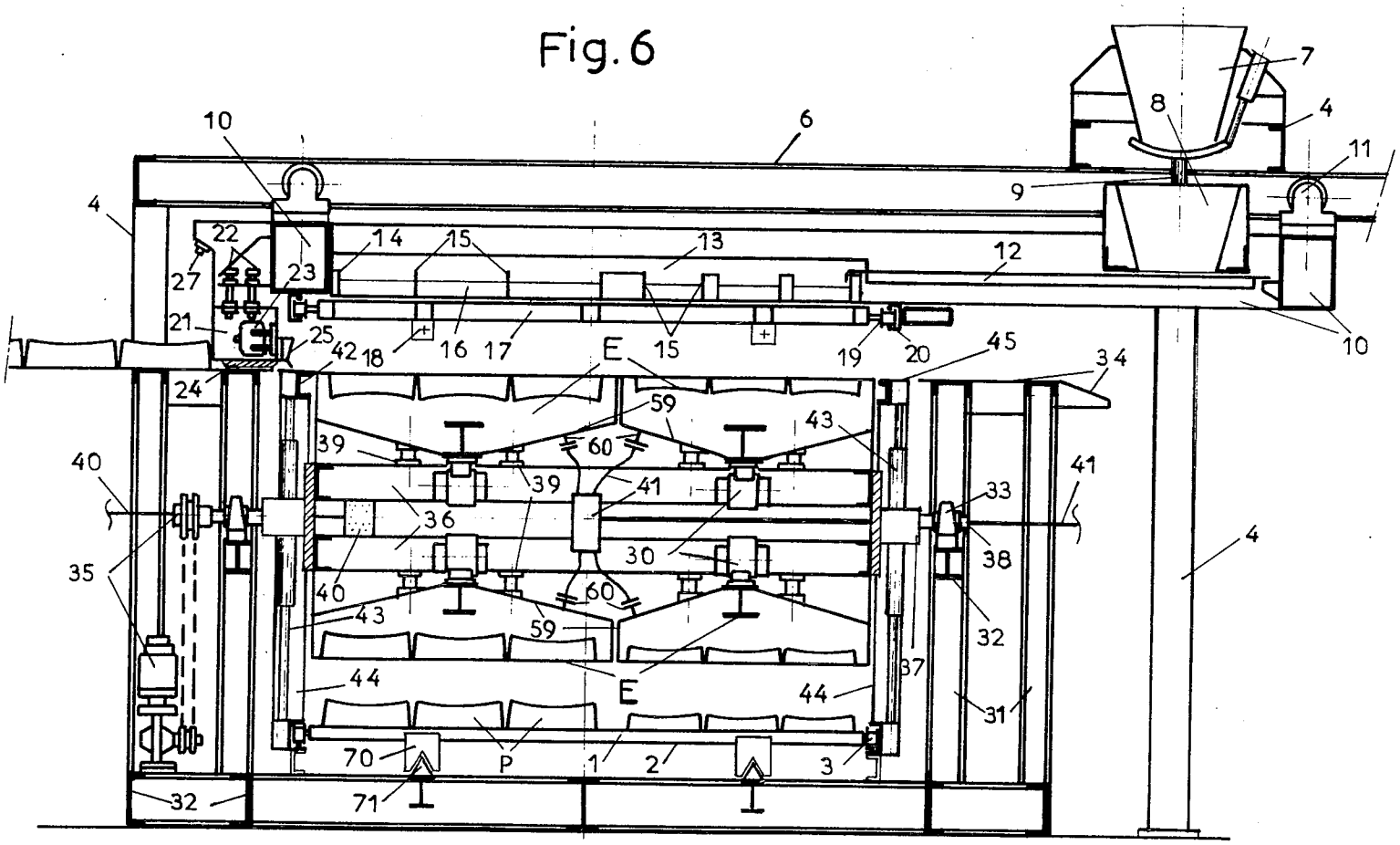
FIG. 6 is a cross-section along I—I (FIGS. 1, 2 and 4) through the casting-unmolding head, having a tilting frame with two rows of molds.
Figure 7:
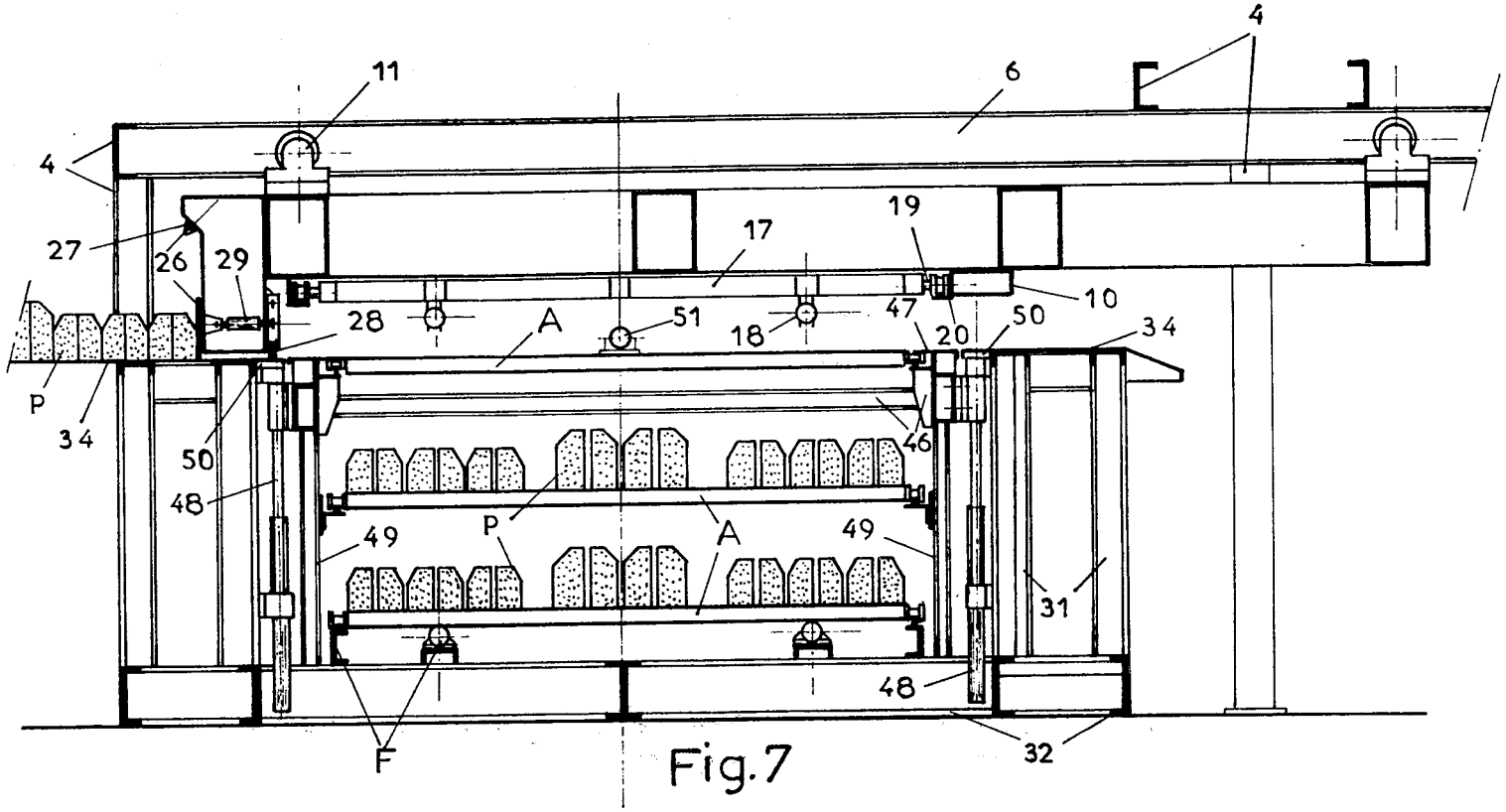
FIG. 7 is a transverse section along the line II—II (FIGS. 1, 2, 3 and 4) through the device pushing finished products from the boards and the device for introducing the latter onto the frame.
Figure 8:
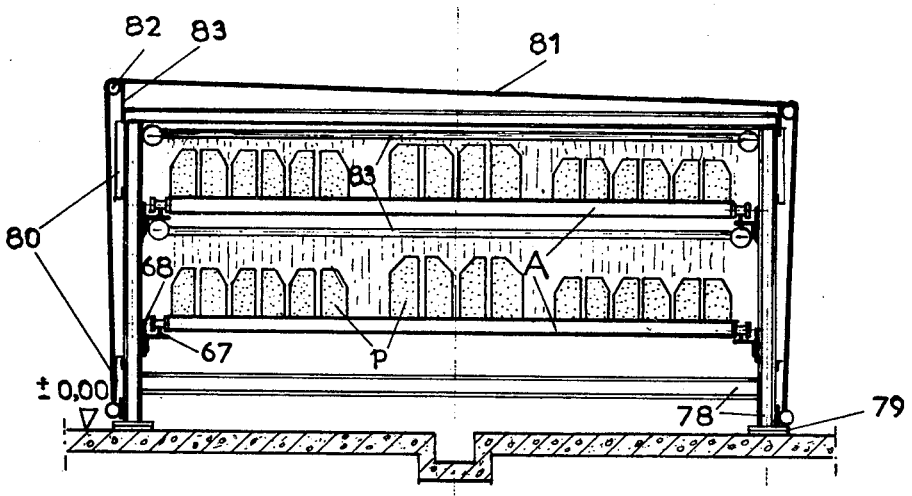
FIG. 8 is a cross-section along the line III—III (FIG. 1) through an overhead hardening circuit.
Figure 9:
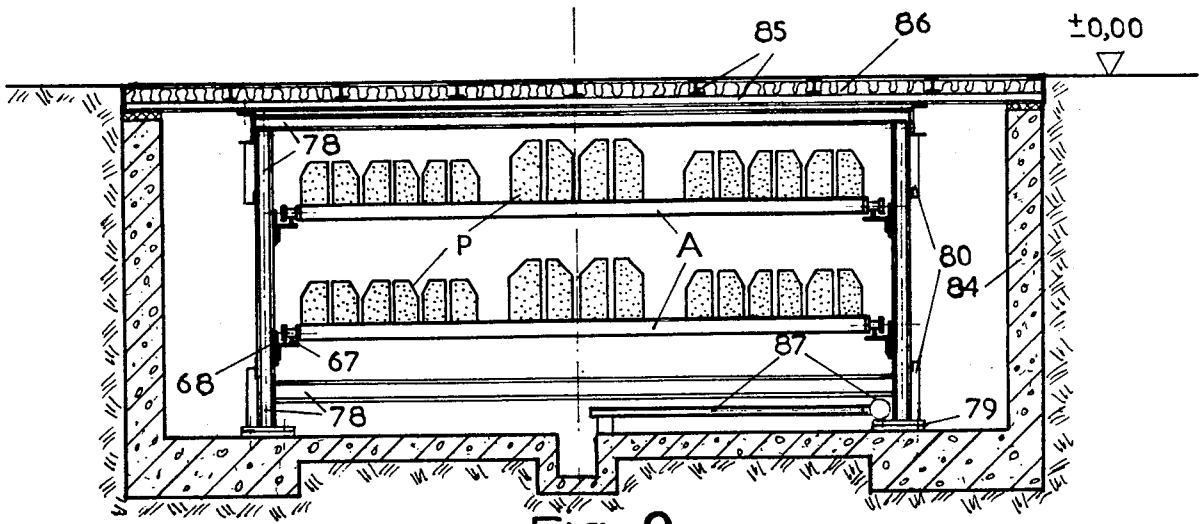
FIG. 9 is a cross-section along the line IV—IV (FIG. 2) through a below ground hardening circuit.

The metal boards A (FIGS. 1 to 9) are constituted by a framework 1, with two sheetmetal surfaces 2, and some bearing and guide rollers 3, so as to ensure alternately on each surface, the closing of the molds during the tilting, the taking of the load of the products P, during the unmolding and routing of the latter along the hardening circuit.

The installation B (FIGS. 1 to 6) includes: a common support framework 4, provided with a working platform 5; two track rails 6, a fixed hopper 7, for supplying concrete; a hopper-buffer 8, provided with some means 9, for adjustment to the vertical; and a carriage-frame 10, provided with a device 11, for to-and-fro movement, and equipped with a proportioning and distribution device for the fresh concrete, with a smoothing device and a device for pushing the hardened products from the installation and for the cleaning and oiling of the boards.

The proportioning and distribution device for the concrete is constituted by platform 12, sliding below the hopper-buffer 8, of an interchangeable box-container, which can contain the fresh concrete necessary for filling, with compacting, the molds underneath, provided with two longitudinal walls 13, two head walls 14, and several intermediate walls 15, connected by some gussets 16, and placed above a trap 17, provided with opening-closing means 18, with some rollers 19 and two roller and guide rails 20.

The smoothing device is constituted by a rule 21, hooked to the beam, on the left side of the carriage-frame 10, by means of elastic suspension and adjustment means 22, and provided with one or several vibrators 23, notably with a vertical axis, with a block 24, and with a knife blade 25.

The device for pushing the hardened products from the installation and for cleaning and oiling the boards, itself also hooked onto the beam, on the left side of the carriage-frame 10, is provided on the front side with a plate 26 (FIG. 7) lined with rubber and with a spraying device 27, and on the rear side with a brush device 28, which can be moved vertically, with the aid of some means 29.

The operation of the installation B, is as follows. In the forward travel, from right to left (see FIGS. 5, 6 and 7) of the carriage-frame 10, the pushing of the hardened products from the board occurring at the side and at the same level as the molds is effected; in the end-of-travel position the trap 17 is opened, discharging concrete into the molds and actuating the compaction of the latter, which compaction is effected by means of some vibrators 30, hooked directly to the molds, after which, in the return travel of said carriage-frame, the smoothing of the concrete and the cleaning and oiling of the boards A is carried out.

The tilting frame C, (FIGS. 1 to 6) includes on the one hand a fixed framework-support, provided with some posts 31, some connecting and reinforcing beams 32, two bearings 33, and some protective walls 34, and on the other hand with a tilting frame-support provided in its turn with one or two devices for receiving and bringing together the boards, with a rotation device 35, and with one or two horizontal frames 36, suspended by the aid of some arms 37, and with two axles 38, on the bearings 33, which frames are provided with means 39, for fixing molds in the desired position, with means 40, for connecting vibrators, and in certain cases with means 41, for connecting to a vacuum pump.

The device for receiving and bringing together the boards comprises two rails 42, two synchronized jacks 43, some guides 44, and some protective means 45, so that, once the molds are filled and the carriage-frame 10 has moved laterally beyond the frame, the two rails 42 ascend into a position above the frame, called receiving position, load the board A, closing it against the molds and actuating at the same time the tilting of the frame. Once this operation is ended and the molds are "face downwards" said rails lower the board provided with unmolded products presenting it at the level of the lower track of the hardening circuit where, loaded by an extraction device, it leaves the frame which, at this precise moment, will tilt back into molds "face upwards" position for repeating the cycle.

The device D (FIGS. 1 to 7) for introducing boards onto the frame includes a platform 46, provided with two receiving rails 47, with raising-lowering means 48, notably one or two jacks, with guide means 49, with locking means 50, and with means 51, for pushing the boards so that, in lower position, the platform 46, being at the level of the upper track of the hardening circuit receives the board A, provided with hardened products, raises it in a first stage to the level of the molds where through the forward travel of the carriage-frame 10, the hardened products are pushed from the board by slate 26 (FIG. 7) and whereby the return travel of the same carriage the board is cleaned and oiled. Thereafter, in a second stage, the board is raised to the receiving level of the rails 42, in which it is pushed by means of jack 51.

Figure 10:
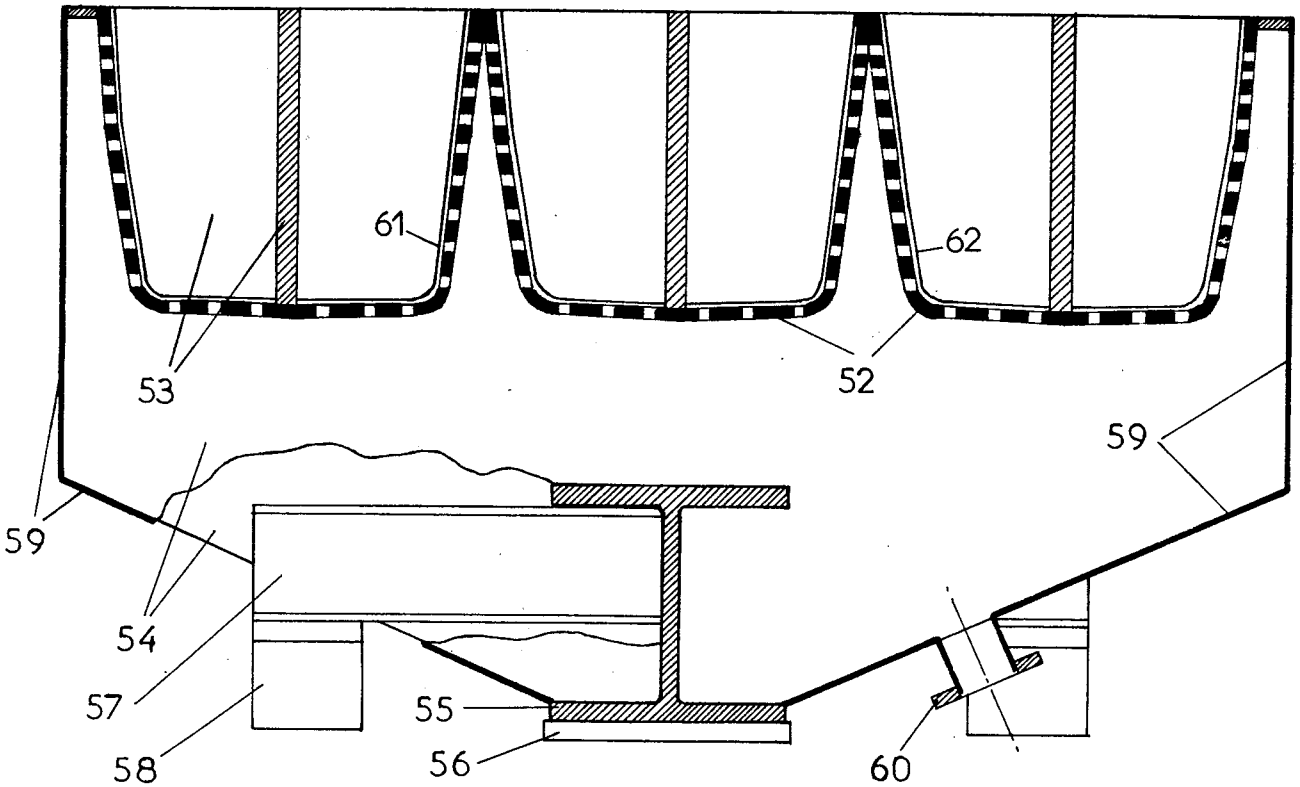
FIG. 10 is a cross-section of a battery of molds for curbs designed according to the modification "I" for finishing the facing surface.
Figure 11:
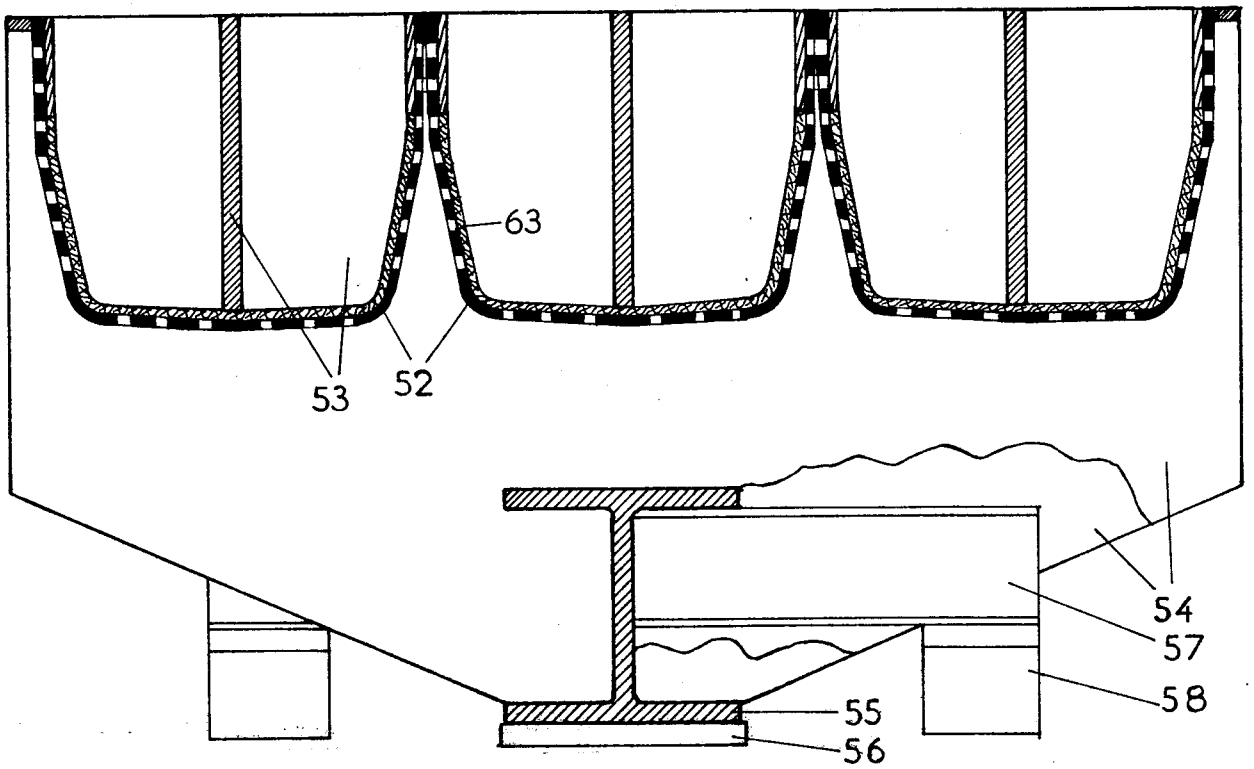
FIG. 11 is a cross-section of the same battery designed according to the modification "II".

The molds or the batteries of molds E (FIGS. 3, 4,5, 6, 10, 11, 12 and 13) provided with one or several shells 52, of folded sheetmetal, with one or several walls 53, with an assembly framework 54, and with one or several beams 55, provided with some plates 56, for hooking vibrators 30, and with some support parts 57, for support on the frame provided with elastic studs 58, are effected in two principal modifications according to the finishing requirements of the viewed surface of the products to be manufactured.

In the first modification ("I") the shell provided with holes, or of perforated sheetmetal, is formed on the contour which has to have a better appearance and the mold or battery of molds is closed with the aid of an envelope 59, notably of sheetmetal, so that, by a connection 60, to a vacuum pump, it is possible to effect a suction phenomenon enabling the maintainance, during the filling and compacting, in the position adhered to said contour, either a floating sheet 61, smooth or provided with stripes or impressions (of paper, textile, plastics material, etc.), or a jacket 62, with a decorative, non-skid coating, etc., and so that, by the stopping of the suction and the unmolding, the sheet or the coating remains adhered to the concrete. Thus, there is obtained on the one hand, the de-aeration of the concrete and an attractive surface for the products (smooth, decorative, non-skid, etc.) and on the other hand easy unmolding, cleanliness of the molds and protection of the bare products against drops of condensed water.

In the second modification ("II"), there is fixed on the shell provided with holes, a filtering layer 63, (of felt, cloth, textile or metal gauze, etc.) so that, by the vibration of the concrete said layer allows excess water and a large amount of air to pass, thus improving not only the surface but also the strength of the concrete.

In certain cases, notably for the manufacture of slabs, when the compacting from above by means of the vibrating rule 21 is sufficient, it is possible to produce a battery with a double row of molds including some assembly frames 64, covered above and below with perforated sheetmetal 65, (FIGS. 12, 13) and provided with two symmetrical rows of support parts 66, provided with support studs 58, so that it is possible to use the two solutions for the finishing of the surface viewed, as described above (see FIGS. 12 and 13).

The hardening circuit includes: a routing means for the boards, on two superimposed tracks, in a tunnel provided with a dismountable frame-support, with different closure means according to the overhead tunnel or below surface tunnel and, in certain cases, means for distributing a heating agent.

The means for routing the boards provided with bare products include: four rails 67, arranged in pairs on two superposed levels and provided with some parts 68, for fastening to the frame-support, an extraction and pushing device for the boards onto the lower track provided with two jacks 69, having at the end of their rod some hooking plates 70, designed so as to slide on a triangular guide 71, which guide is fixed to the framework 32, in order to avoid any non-axial force in said rod, and a transfer device for the boards between the two tracks of the tunnel, provided in its turn with two pusher jacks 72, and with a platform 73, provided with two rails 74, with one or two raising and lowering jacks 75, and some guides 76, so that in the "platform below" position, the latter receives at each speed one board and that in "platform above" position said board is pushed, at the same speed, onto the upper return track.

The support-rame is constituted by a frame 77, for supporting the transfer device, and with a series of bearing members 78, provided with means 79, for fastening to the ground and with cross-bracing means 80, so that, placed above the ground and closed by an isothermal envelope 81, with the aid of some tubes 82, and some fastening parts 83, it provides a dismountable aerial tunnel and so that the same framework placed in a vat 84, as a support for a floor 85, provided with thermal isolation 86, provides a below ground tunnel, also dismountable.

The above-described circuit can be used with or without accelerated hardening of the concrete. In the first case, there is provided in the tunnel either a network 87, for the distribution of steam, or a network 88 for spraying with hot water, or again with other heating means such as for example infrared radiators, etc.

The various installations and devices described above, connected to a central control board 89, give a multipurpose installation for the manufacture of a large range of small and medium products of reinforced and unreinforced concrete, with a substantial improvement in the quality and the cost price.

What is claimed is:

1. A multi-purpose manufacturing installation for the manufacture of small and medium products of reinforced and unreinforced concrete, comprising:

a hardening circuit including means for routing boards supporting the concrete products therethrough;

a tilting frame including at least one mould thereon which is closable by one of said boards;

a distributing means for distributing the concrete into the mould;

an introducing means for introducing boards one by one onto the tilting frame for closing the mould after it has been filled with concrete;

means for tilting the tilting frame through 180° after the mould has been filled with concrete and closed;

means operable after the tilting frame has been tilted through 180° for causing the downward movement away from the mould of a board which is provided with products thereon and which have been removed from the mould to a position appropriate for introduction of the board and its products into the hardening circuit, and introducing means for introducing this board into the hardening circuit, which circuit extends over a closed path returning to a position adjacent to the tilting frame;

and a discharging means for discharging the hardened products off of their respective boards and away from the manufacturing installation and for cleaning the boards after the hardened products have been removed therefrom;

wherein said distributing means and said discharging means are combined so as to form a common unit which comprises a reciprocally movable carriage equipped with a concrete measuring and distribution device for the fresh concrete and a pushing device for pushing the hardened products out of the manufacturing installation and for cleaning and oiling the boards, this pushing device being situated on the carriage beside the measuring device so that during the outward travel of the carriage the pushing device ensures the pushing of the hardened products from a board which is located at the side of and at the same vertical level as the top of the mould, such that as the concrete distributing device is brought into position above the mould, the pushing device pushes the hardened products on the board beside the mould away from the manufacturing installation, and at the end of the outward travel of the carriage the concrete is discharged into the mould and such that, during the return travel of the carriage the board from which the hardened product has just been removed is clean, after which this board is then moved into position to close the mould which has just been filled.

2. A manufacturing installation according to claim 1, wherein the pushing device is connected to the carriage on one end thereof, this pushing device being provided on the outward facing surface thereof with a soft surface plate and a spraying device, and provided at the rear thereof with a vertically movable brush device.

3. A manufacturing installation according to either of claims 1 or 2, wherein the concrete measuring and distributing device comprises a smoothing device formed by a rule connected to the carriage at the same end of this carriage as the pushing device but to the side of the pushing device, this rule being connected to the carriage by elastic suspension and adjustment means, said rule being provided with at least one vibrator mounted on a guide block and with a knife blade positioned to smooth concrete in the mould during the return travel of the carriage.

4. A manufacturing installation according to claim 1, wherein the common unit for distributing the concrete and discharging the hardened products away from the manufacturing installation and for cleaning and oiling the boards comprises a common supporting framework, provided with a work platform, with two running rails for the carriage, with a fixed hopper for feeding the concrete and with a buffer hopper provided with means for vertical adjustment.

5. A manufacturing installation according to claim 1, wherein the concrete measuring and distributing device comprises an interchangeable box-container having means for containing the fresh concrete required for filling the moulds situated therebelow, a trap provided below the box-container and having opening and closing means, and including a work platform adjacent the box-like container and positioned to slide below a buffer hopper when the box-container has moved over the mould.

6. A manufacturing installation according to claim 1, wherein each board is formed by a framework having two sheet-metal faces and by guiding and running rollers on the sides thereof, such that either face of each board is capable of closing the moulds during tilting of the frame, receiving the products during removal from the mould and of being routed along the hardening circuit.

7. A manufacturing installation according to claim 1, said tilting frame being provided with two devices for clampingly receiving the boards and with two horizontal frames each provided with means for securing the moulds so that the operations of filling certain moulds with concrete and removing products downwardly from other moulds on the tilting frame can be carried out simultaneously.

8. A manufacturing installation according to claim 1 or 2, wherein the said introducing means comprises a receiving platform provided with receiving rails, means for raising and lowering said receiving platform, locking means and means for pushing the boards, the whole of this introducing means being such that, in the lower position, the receiving platform is at the level of the hardening circuit for receiving a board provided with hardened products, said receiving platform then raising this board to the level of the moulds so that during the outward travel of the carriage the hardened products are pushed off of the board, and whereas during the return travel of this same carriage said board is cleaned and oiled, and such that after the return travel of the carriage the platform raises the board to a level for being pushed into a receiving device for receiving and clamping the board on the moulds under the action of the pushing means pushing said board into said reception device.

9. A manufacturing installation according to claim 8, wherein the receiving device for receiving and clamping the boards on the moulds comprises two rails, synchronized jacks for moving the rails and vertical guides, the whole of the receiving device being such that the two rails are mounted above the frame to receive a board which has just been cleaned and oiled, and to press this board against the moulds while concurrently controlling the tilting of the tilting frame, and so that, when the tilting operation is finished, said rails are operable to lower the board provided with products removed from the moulds to the position appropriate for introduction of the boards and its products into the hardening circuit.

10. A manufacturing installation according to claim 1, wherein the mould is provided with one or more shells provided with holes on the contour which faces the surface of the product which is intended to have a better appearance, this mould being closed by means of an envelope made from sheet-metal or the like so that by coupling the shell to a vacuum pump there is provided a suction phenomenon for maintaining in a clinging position on said contour of either a loose sheet or a jacket with a decorative or non-skid coating.

11. A manufacturing installation according to claim 10, wherein the mould, particularly for the manufacture of slabs, is formed by a double-row battery comprising assembly frames covered at the top and at the bottom with perforated metal sheet.

* * * * *